US005178679A

United States Patent [19]

Josefsson

[11] Patent Number: 5,178,679

[45] Date of Patent: Jan. 12, 1993

[54] PAINT SPRAY BOOTH WITH LONGITUDINAL AIR FLOW

[75] Inventor: Leif E. B. Josefsson, Sterling Heights, Mich.

[73] Assignee: ABB Flakt, Inc., Madison Heights, Mich.

[21] Appl. No.: 702,826

[22] Filed: May 20, 1991

[51] Int. Cl.[5] ..... B05B 15/12; B05C 15/00

[52] U.S. Cl. ..... 118/309; 118/326; 454/51; 454/53

[58] Field of Search ..... 454/50, 51, 53; 118/309, 326, DIG. 7, 634

[56] References Cited

U.S. PATENT DOCUMENTS 1,697,079 1/1929 Onsrud .
3,741,155 6/1973 Hunder .
3,921,576 11/1975 Vertue .
4,338,364 7/1982 Kennon et al. .
4,901,666 2/1990 Nagasaka et al. .

FOREIGN PATENT DOCUMENTS

2936367A1 3/1981 Fed. Rep. of Germany .
1212617 2/1985 U.S.S.R. .
2160639 12/1985 United Kingdom .

*Primary Examiner*—W. Gary Jones
*Assistant Examiner*—Charles K. Friedman
*Attorney, Agent, or Firm*—Harness, Dickey & Pierce

[57] ABSTRACT

A paint spray booth utilizes longitudinal air flow along paths parallel to a path of travel through a tunnel in the booth of objects to be painted, the air flow directed inwardly from both entrance and exit ends of the tunnel. An exhaust duct for the inwardly directed, longitudinally flowing air is positioned between the entrance and exit ends and includes an exhaust slot which surrounds at least a portion of a paint spray application area within the tunnel for drawing out overspray-laden exhaust air. Maintaining flow of exhaust air along the path of travel of the painted objects increases paint transfer efficiency and minimizes contamination of paint recovered from the exhaust air. The invention finds particular advantage in powder spray booth applications and is adapted to modularization thereby enabling retrofitting of existing spray booths with apparatus arranged in accordance with the principles of the invention.

12 Claims, 4 Drawing Sheets

PAINT SPRAY BOOTH WITH LONGITUDINAL AIR FLOW

BACKGROUND OF THE INVENTION

The invention generally relates to paint spray booths. More particularly, the invention concerns paint spray booths utilizing longitudinal exhaust air flow through the booth from both ends thereof towards a centrally located exhaust system.

Designers of conventional paint spray booths have traditionally attempted to deal with improving paint transfer efficiency therein. Much of the paint spray, especially in powder spray booths, never reaches the target being painted and becomes so-called "overspray" which must be removed from an air stream in the booth. Overspray, in turn, leads to build up problems on booth walls surrounding the paint spray application area. Cleaning the booth walls in this area typically has required costly shut down of the spray booth for manual cleaning of its interior walls.

One known approach to minimizing overspray buildup in a powder spray booth is taught in U.S. Pat. No. 3,921,576 to Vertue, wherein the spray chamber is surrounded by porous walls through which a gas, such as air, passes to counteract deposition of paint powder on the wall, thus facilitating cleaning of the booth. A similar concept is taught in U.S. Pat. No. 3,741,155 to Hunder. However, neither the Vertue nor the Hunder patents suggest use of the inward air flow through the porous walls to increase paint transfer efficiency by directing variably controlled air flow through the porous wall toward the object being painted.

Additionally, none of the art presently known to applicant utilizes exhaust air flow through a paint spray booth which exits the booth other than through a conventional grated flooring thereof.

SUMMARY OF THE INVENTION

Accordingly, the invention provides a paint spray booth having an outer ceiling and a floor interconnected by two outer booth side walls to define a tunnel with an entrance end and an exit end, with articles to be painted moving longitudinally along the tunnel from the entrance end to the exit end. Air inlet means at the entrance and exit ends are provided for directing air flow longitudinally inwardly from the exit and entrance ends along paths substantially parallel to a path of travel of the articles to be painted. Air exhaust apparatus located at a preselected location in the tunnel between the entrance and exit ends is operative to withdraw air introduced by the air inlet means from the tunnel at the preselected location.

It is a feature of this invention that laminar exhaust air flow is maintained in a direction of travel generally parallel to that of the object being painted thereby maintaining paint spray in contact with the target for prolonged periods of time to improve paint transfer efficiency.

It is a further feature of the invention that proper air velocity is maintained about the painted object in the tunnel of the booth with minimization of velocity differentials such as high velocity areas which adversely affect paint transfer efficiency and overspray buildup.

Additionally, in combination with the longitudinal air flow through the spray application area, the invention contemplates a perforate inner wall surrounding at least a portion of the paint application area in the tunnel, the perforate inner wall spaced inwardly from the outer ceiling and outer side walls of the booth and defining an area surrounding the perforate inner wall for receipt of air under pressure directed against the perforate inner wall, the perforate inner wall operative to admit supplemental inlet air into the paint application area away from the inner wall toward the path of travel of the articles being painted.

BRIEF DESCRIPTION OF THE DRAWINGS

The objects and features of the invention will become apparent from a reading of a detailed description taken in conjunction with the drawings, in which.

DETAILED DESCRIPTION

Figure 1:
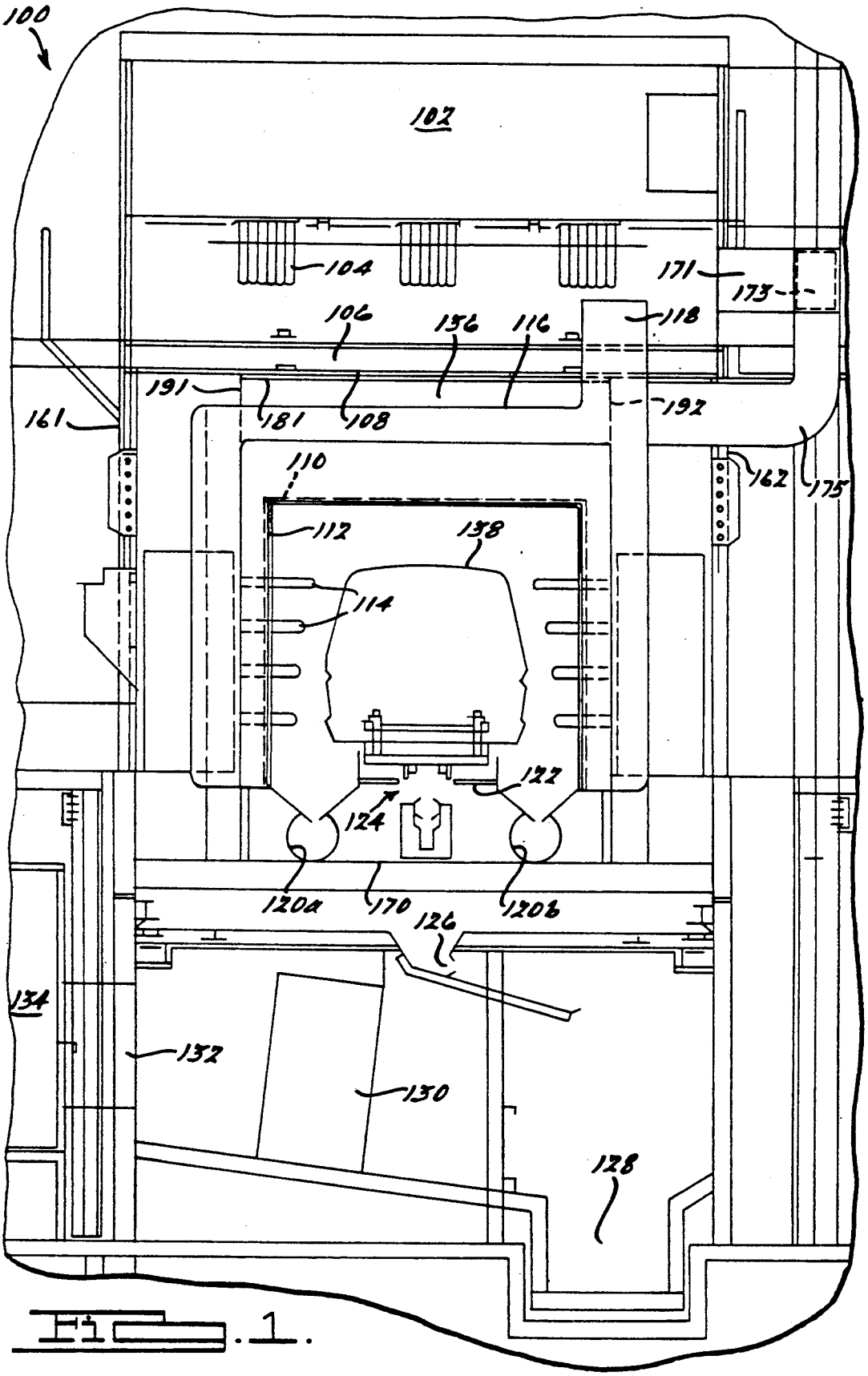
FIG. 1 is a lateral sectional view in the vicinity of a centrally located exhaust duct in a paint spray booth arranged in accordance with the principles of the invention.
Figure 2:
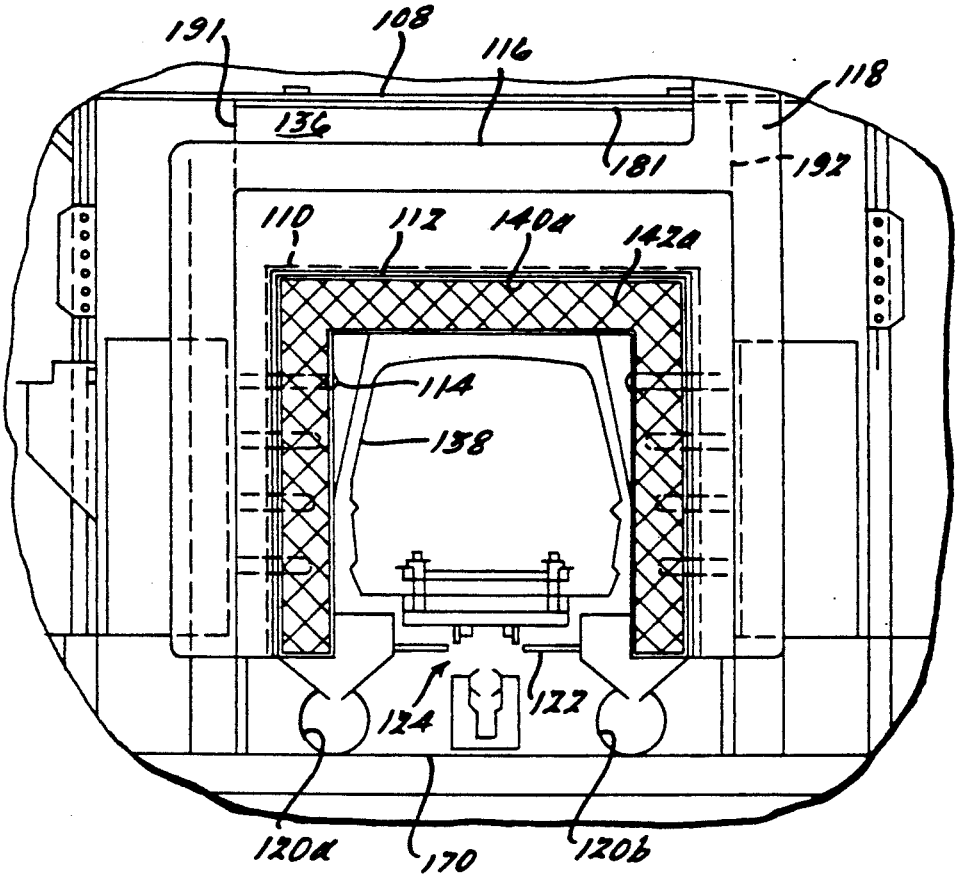
FIG. 2 is a lateral sectional view at one end of the booth of FIG. 1 showing one air inlet cross-section.
Figure 3:
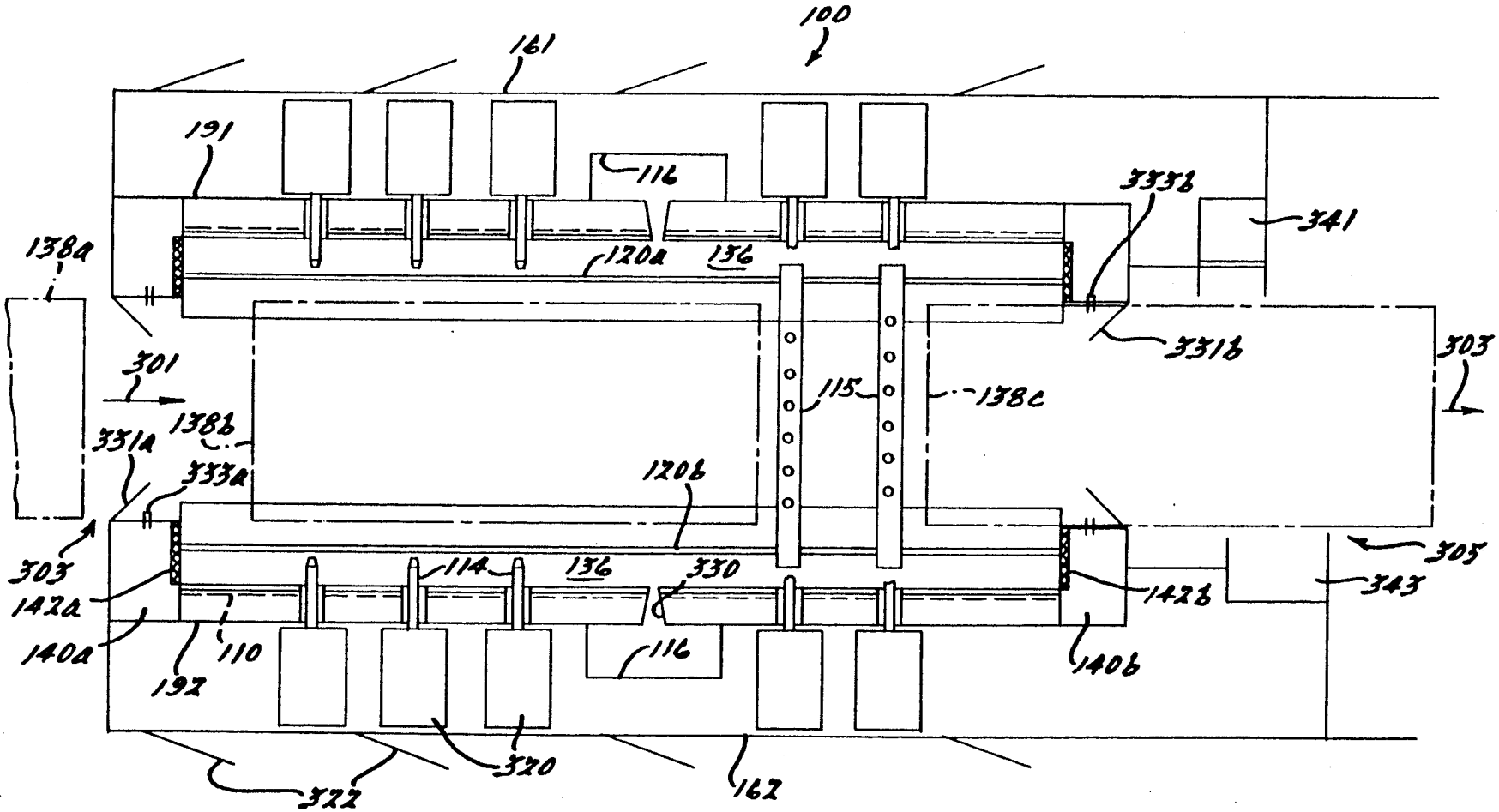
FIG. 3 is a partial sectioned top view of the booth of FIG. 1.

With reference to FIGS. 1, 2 and 3, powder spray booth 100 includes a conventional air inlet system 102 which includes a controlled fan arrangement for bringing inlet air into the interior o the booth. Inlet air from system 102 flows downwardly through filter bags 104 and then is withdrawn via fan inlet duct 171 via controlled fan 173 to fan outlet duct 175 which feeds air under controlled pressure into area 136 to be further described below. Air exiting from filter bags 104 additionally passes, at a much lower rate, through the booth conventional grated ceiling 108 at outer sides thereof to ventilate the outer peripheral areas of the spray booth between outer wall 161 and partition 191 and between outer wall 162 and partition 192 Area 136 which receives air from fan 173 under higher pressure is isolated by blocking plate 181 from the air entering via grated ceiling 108.

Located within a tunnel of the booth formed by grated booth ceiling 108 and booth partitions 191 and 192 is a perforated liner or wall 110 in which the perforation sizes may be adjusted, such as by the relative sliding motions of two abutting perforated plates. Located interiorly of and abutting wall 110 is a layer of suitable filter material 112. Extending through perforated wall 110 and filter material 112 are a plurality of laterally directed powder spray applicators 114 and one or more overhead spray units 115 (FIG. 3) which are vertically adjustable. The bodies to be painted are designated 138, and these bodies are carried longitudinally through the booth along a path of travel parallel to a longitudinal axis of the booth by a conveyor system 124, which is adjacent to two service access floor gratings 122 on either side of conveyor system 124. Beneath the grating 122 is a conventional grated floor of the booth 170. Beneath grated floor 170 is a paint/air separator system comprised of a venturi passageway 126, a powder-laden water recovery chamber 128, a labyrinth water/air separator 130 from which air is exhausted by a plenum 132 to a non-recirculated exhaust duct 134. This separator and exhaust system located beneath grated floor 170 is a conventional arrangement and is isolated (i.e. not in fluid communication) from the centrally located exhaust apparatus to be described below.

Located just above grated floor 170 on either side of conveyor system 124 and adjacent bottom edges of adjustable perforated wall 110 are a pair of powder overspray supplementary exhaust ducts 120*a* and 120*b*, each of which includes a longitudinally extending slot for the withdrawal of spray-laden air therethrough towards the bottom of the paint application chamber situated within adjustable perforated wall 110.

An annular volume surrounding adjustable perforated wall 110 is designated 136 (also see FIG. 3) and receives inlet air from fan 173 and duct 175. This air is forced under pressure through the perforations in wall 110. This air movement directed inwardly of perforated wall 110 serves the dual purpose of minimizing overspray buildup on the interior surface of wall 110 and increasing the paint transfer efficiency by providing a secondary draft of air flow towards the articles 138 being coated. Volume 136 is defined by wall 110, blocking plate 181 and booth partitions 191 and 192.

At inlet or entrance end 303 and outlet or exit end 305 of booth 100 (FIG. 3) are located air inlet elements comprised of a generally U-shaped or "horseshoe" shaped air inlet ducts 142*a* and 142*b* (see especially FIGS. 2 and 3). Air in the pressurized chamber 136, in addition to being directed through the perforations in wall 110 is directed through much larger perforations at a higher volume flow rate through end perforated sections 142*a* and 142*b* to set up a laminar flow of inlet air into the booth from both the inlet or entrance end 303 and the outlet or exit end 305 of booth 100. This generally parallel flow to the path of travel of bodies 138 being spray painted increases paint transfer efficiency by maintaining the spray powder in close proximity to the articles being coated as they move through the booth's tunnel. The perforations in inlet elements 142*a* and 142*b* may also be adjustable (such as by using two relatively movable parallel perforated plates) to vary the flow rate of longitudinally moving inlet air.

The inwardly flowing, longitudinally directed air is then principally exhausted from the spray application area via U-shaped or horseshoe shaped exhaust duct 116 located intermediate entrance end 303 and exit end 305. The horseshoe shaped duct 116 withdraws the air from the booth and sends it via air exhaust duct 118 to a powder spray recovery area so that overspray carried through this centrally located exhaust duct may be later used by powder spray applicators 114 or 115. Exhaust duct 118 is also in fluid communication with supplementary ducts 120*a* and 120*b*.

It is to be understood that exhaust duct 116 includes an exhaust opening 330 (FIG. 3) extending for at least a portion of the periphery of the spray applicator chamber defined by perforated wall 110. Exhaust opening 330 preferably extends substantially completely around the side and ceiling periphery of the chamber defined by wall 110.

It will be seen, especially from FIGS. 1 and 2, that supplementary exhaust ducts 120*a* and 120*b* and main exhaust duct 116 are arranged such that only powder overspray which has not come in contact with contaminating elements of the conveyor system 124 or the access service grating 122 lying beneath the path of travel of the articles 138 is withdrawn through the main and supplemental ducts. Hence, overspray exiting the booth via either the centrally located horseshoe type of exhaust duct 116 or the supplemental ducts 120*a* and 120*b* contain only powder overspray which is substantially free of contaminants and therefore able to be recycled for later re-use.

With reference to FIG. 3, inlet air may optionally be additionally injected at the entrance end 303 and the exit end 305 of the booth via respective nozzles 333*a* and accompanying diverter plate 331*a* and nozzle 333*b* and its accompanying diverter plate 331*b*. This auxiliary inlet air at the ends of the booth's tunnel insures the minimization of any "dead zones" near the booth openings at either end 303 and 305 to prevent escape of overspray-laden exhaust air.

To recap the advantages of the invention as embodied in the arrangement set forth in FIGS. 1–3, adjustable perforations in porous wall 110 are used to (a) increase paint transfer efficiency by providing air flow from the walls towards the object 138 being painted and (b) maintain the inner wall of the spray chamber in a substantially clean state free of over-spray build-up.

Furthermore, in accordance with the principles of the invention, forcing inlet air flow along paths parallel (both with and against) the path of travel of the objects 138 being painted within the booth, forces any overspray to also travel along the booth with the articles being coated therefore increasing the time duration that the spray is in immediate contact with the article, which in turn increases paint transfer efficiency. This longitudinal flow of air through the booth additionally promotes evenness in the air flow at different areas of the cross section of the spray application area. Prior art arrangements utilizing ceiling to floor exhaust air flow induce regions of higher velocity flow which leads to uneven distribution of the spray coating upon the articles passing through the booth.

Horseshoe or U-shaped centrally located exhaust duct 116 acts as a vacuum ring withdrawing air out of the booth from both ends, the air travelling substantially parallel to movement of articles 138 through the booth.

Supplemental exhaust ducts 120*a* and 120*b* assist in removal of that portion of the powder overspray which may fall by gravity toward the floor of the spray booth before such overspray can come in contact with contaminating apparatus underneath the articles being painted such as conveyor system 124 and service access grating 122.

It has been found preferable to supply on the order of 90% of the inlet air flow via the horseshoe shaped ducts 142*a* and 142*b* at either end 303 or 305 of the booth and on the order of about 10% of the inlet air flow through the perforated liner or wall 110 surrounding the paint application chamber. Since the overspray powder will not tend to travel against the flow of exhaust air, then the entrance and exit ends 303 and 305, respectively, can be left open for continuous movement of articles 138 through the booth in the direction of arrow 301 and 303 (FIG. 3).

As seen from FIG. 3, booth 100 may additionally include a plurality of maintenance access doorways 322 leading into an interior area which, among other things, houses the spray gun assembly units 320.

Figure 4:
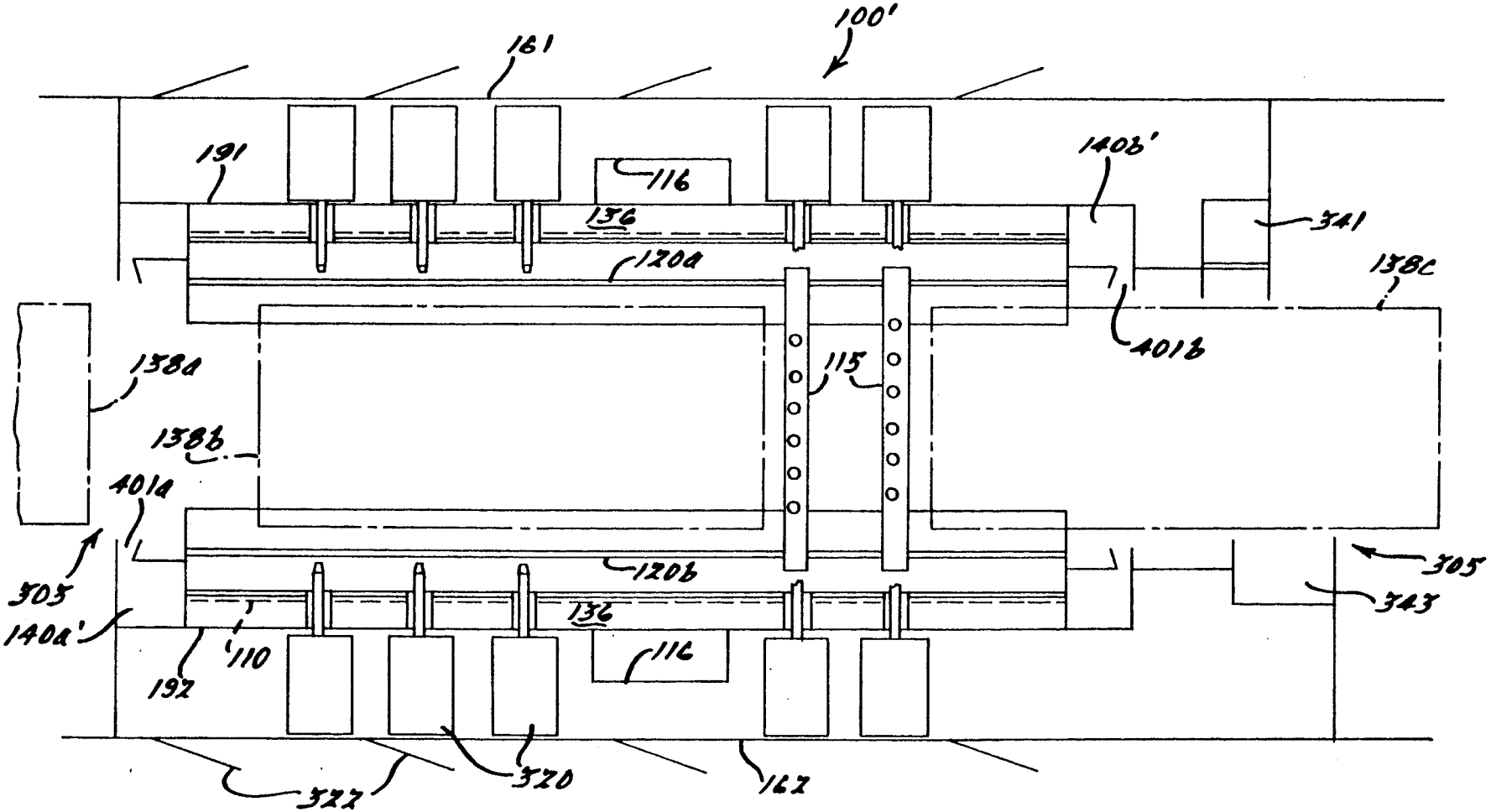
FIG. 4 is a partial sectioned top view of an alternative embodiment of a booth arranged in accordance with the principles of the invention.

FIG. 4 depicts a partially sectioned top view of an alternative embodiment of a spray booth arranged in accordance with the principles of the invention. Spray booth 100' is substantially identical to the booth depicted in FIGS. 1 through 3 with the exception of the air inlet arrangements at the booth ends 303 and 305. In the booth of 100', air inlet nozzles 401*a* and 401*b* extend peripherally around the tunnel and direct inlet air towards the center of the booth for expulsion by centrally located duct 116 and supplemental ducts 120*a* and 120*b*.

Additionally shown in the booths 100 and 100' of FIGS. 3 and 4, respectively, is a known body cavity ventilating system comprised of a ventilating air inlet duct 341 and a ventilating air exhaust duct 343. Air flow laterally across the booth's tunnel from inlet duct 341 to exhaust 343 is directed through the interior of the articles 138 being coated and is utilized to remove overspray trapped inside the body as it has traversed the booth. For this reason the body cavity ventilating system is located at the outlet or exit end 305 of booths 100 and 100' of FIGS. 3 and 4, respectively.

Finally, it will become apparent to those skilled in the art that the example arrangements of the invention set forth in FIGS. 1–4 readily lend themselves to modularization and retrofitting of existing conventional paint spray booths with traditional inlet air supplies and separator/exhaust systems.

The invention has been described with reference to detailed descriptions of preferred embodiments given for the sake of example only. The scope and spirit of the invention are set forth in the appended claims.

I claim:

1. In a paint spray booth having an outer ceiling and a floor interconnected by two outer booth side walls to define a tunnel with an entrance end and an exit end with articles to be painted moving longitudinally along and through the tunnel from the entrance end to the exit end, the improvement comprising:

air inlet means at the entrance and exit ends for directing air flow longitudinally inwardly from the exit and entrance ends along paths substantially parallel to the path of travel of the articles to be painted; and air exhaust means located at a preselected location in the tunnel between the entrance and exit ends and operative to withdraw air introduced by the air inlet means from the tunnel at the preselected location, wherein the air exhaust means comprises an exhaust duct means having an exhaust opening therein surrounding at least a portion of an outer periphery of a paint spray application zone located within the tunnel.

2. The improvement of claim 1 further comprising a perforate inner wall means surrounding at least a portion of a paint application area in the tunnel, the perforate inner wall means spaced inwardly from the outer ceiling and outer side walls of the booth and including means for defining an annular volume surrounding the perforate inner wall means for receipt of air under pressure directed against the perforate inner wall means, the perforate inner wall means operative to admit supplemental inlet air into the paint application area away from the inner wall means toward the path of travel of the articles being painted.

3. The improvement of claim 2 wherein the perforate inner wall means includes means for adjusting opening size of perforations in the inner wall means to thereby adjust air flow rate therethrough.

4. The improvement of claim 2 further comprising at least one supplemental air exhaust means extending longitudinally of the tunnel near a bottom edge of the inner wall means adjacent the path of travel of the articles to be painted, the supplemental air exhaust means including a slotted opening extending longitudinally for substantially an entire length of a paint spray station within the tunnel, the supplemental air exhaust means operative to draw out overspray falling toward a bottom of the booth while substantially isolating such withdrawn overspray from contact with any apparatus positioned beneath the path of travel of the articles to be painted.

5. The improvement of claim 1 wherein the air inlet means includes an annular zone facing inwardly toward the tunnel from the entrance and exit ends and further including inlet perforate walls for directing inlet air inwardly along the booth from both entrance and exit ends.

6. The improvement of claim 5 wherein the inlet perforate walls include means for adjusting opening size of perforations therein to thereby adjust air flow rates therethrough.

7. In a paint spray booth having a perforated ceiling and a perforated floor interconnected by two outer booth side walls to define a tunnel with an entrance end and an exit end with articles to be painted moving longitudinally through and along the tunnel from the entrance end to the exit end, a source of inlet air, and a paint spray/air separator and air exhaust system positioned beneath the perforated floor, the improvement comprising:

air inlet means at the entrance and exit ends for directing air flow longitudinally inwardly from the exit and entrance ends along paths substantially parallel to a path of travel of the articles to be painted;

a perforate inner wall means extending substantially parallel to a longitudinal direction of movement of the articles to be painted and surrounding at least a portion of a paint application area in the tunnel and spaced inwardly from the perforated ceiling and outer side walls of the booth and including means for defining an annular volume surrounding the perforated inner wall means in communication with the source of inlet air for receipt of air under pressure directed against the perforate inner wall means, the perforate inner wall means operative to admit supplemental inlet air into the paint application area away from the perforate inner wall means toward the path of travel of the articles being painted;

air exhaust means separate from the air exhaust system associated with the paint spray/air separator, the air exhaust means positioned in the tunnel between the entrance and exit ends and having an exhaust opening surrounding at least a portion of an outer periphery of the paint application area above the perforated floor; and first and second supplementary air exhaust means in fluid communication with the air exhaust means and extending longitudinally along the tunnel between the perforated floor and the paint application area on either side of the path of travel of the articles to be painted, the first and second supplementary air exhaust means each including a slotted opening extending longitudinally for substantially an entire length of the paint application area and operative to draw out overspray falling toward the perforated floor while substantially isolating such withdrawn overspray from contact with any apparatus positioned beneath the path of travel of the articles to be painted.

8. The improvement of claim 7 further comprising a secondary perforated floor positioned immediately under the path of travel of the articles to be painted between the first and second supplementary air exhaust means in fluid communication with the perforated floor of the booth.

9. The improvement of claim 7 wherein a flow rate of the supplementary air exhaust means is less than a flow rate of the longitudinal air flow from the exit and entrance ends along paths substantially parallel to the path of travel of the articles to be painted.

10. The improvement of claim 7 wherein the air inlet means include an annular zone facing inwardly toward the tunnel from the entrance and exit ends and further including inlet perforate walls extending substantially transversely of the longitudinal direction of movement of the articles to be painted for directing inlet air inwardly along the booth from both entrance and exit ends.

11. The improvement of claim 10 wherein the inlet perforate walls include means for adjusting opening size of perforations therein to thereby adjust air flow rates therethrough.

12. The improvement of claim 7 wherein the perforate inner wall means includes means for adjusting opening size of perforations in the inner wall means to thereby adjust air flow rates therethrough.

* * * * *